US006675485B1

(12) United States Patent
Shih et al.

(10) Patent No.: US 6,675,485 B1
(45) Date of Patent: Jan. 13, 2004

(54) ARTISTIC KNIFE WITH ADJUSTABLE HANDLE

(76) Inventors: Shih-Chin Shih, P.O. Box 697, Feng-Yuan City, Taichung Hsien (TW), 420; Yin-Hae Huang, P.O. Box 697, Feng-Yuan City, Taichung Hsien (TW), 420

( * ) Notice: Subject to any disclaimer, the term of this patent is extended or adjusted under 35 U.S.C. 154(b) by 0 days.

(21) Appl. No.: 10/255,595

(22) Filed: Sep. 27, 2002

(51) Int. Cl.[7] ..... B26B 1/04
(52) U.S. Cl. ..... 30/321; 30/330
(58) Field of Search ..... 30/330, 321, 340, 30/319, 320, 307, 161, 160, 339, 331, 265, 517

(56) References Cited

U.S. PATENT DOCUMENTS 3,983,595 A * 10/1976 Knudsen et al. ..... 15/236.02
3,994,066 A * 11/1976 Lebo ..... 30/321
4,100,677 A * 7/1978 Jeff ..... 30/321
4,912,349 A * 3/1990 Chang ..... 310/50
5,722,168 A * 3/1998 Huang ..... 30/161
5,930,902 A * 8/1999 Hsu ..... 30/331
6,415,514 B1 * 7/2002 Chun ..... 30/162
6,460,254 B1 * 10/2002 Mori et al. ..... 30/286

* cited by examiner

*Primary Examiner*—Allan N. Shoap
*Assistant Examiner*—Ghassem Alie

(57) ABSTRACT

An artistic knife with adjustable handle includes a straight handle which is combined with a pair of first and second halves, a head rotatably gripped by the straight handle and having a blade on front end and an annular ring on rear end sleeved on a tubular projection of the first half. The annular ring has an inner flange in which a plurality of pairs of mortises are symmetrically formed. A positioning member disposes into the tubular projection and biased by a spring and has a protrudent surface engaged within a circular through hole of the second half through the annular ring and a large tenon and a small tenon on opposing outer peripheries respectively engaged with the mortises. Thereby, press the positioning member inward to enable the head to rotate a certain degree of angle between the head and the straight handle. Then release the positioning member which controls the movement of the head.

4 Claims, 6 Drawing Sheets

ARTISTIC KNIFE WITH ADJUSTABLE HANDLE

BACKGROUND OF THE INVENTION

The present invention relates to cutters and more particularly to an artistic knife with adjustable handle which handle can be bent into different angles in order to fit the requirement of the users.

Normally, a heavy duty artistic knife has a blade in one end of the handle which may be in straight form or in arcuate form. The blade in a straight handle forms a small angle with a work piece. Whereas the blade in an arcuate handle can form a large angle with the work piece. So that the user has to prepare a lot of artistic knives of different angled handles in order to finish his job, causing great inconvenience.

SUMMARY OF THE PRESENT INVENTION

The present invention has a main object to provide an artistic knife with adjustable handle for which the user can be able to change the angle of the blade relative to the straight portion of the handle to perform his job on a work piece.

Another object of the present invention is to provide an artistic knife with adjustable handle by which the user can save a large sum of cost by enjoy a great convenience.

Accordingly, the artistic knife of the present invention comprises generally a straight handle combined with a first half and a second half, a head having a blade in a first end and an annular ring rotatably sleeved on a tubular projection of the first half and a positioning member controlling the movement of the annular ring. The annular ring has pairs of mortises spacedly and symmetrically formed in the inner periphery in registry with a large tenon and a small tenon which are symmetrically formed on opposite outer periphery of the positioning member. Upon the above structure, press in the positioning member to disengage the tenons with the mortises in order to set the head free to rotate. Then release the positioning member, the tenons will automatically engage with a pair of mortises when the head is already turned at a certain degree angle relative to the straight portion of the handle.

The present invention will become more fully understood by reference to the following detailed description thereof when read in conjunction with the attached drawings.

DETAILED DESCRIPTION OF THE PREFERRED EMBODIMENT

Figure 1:
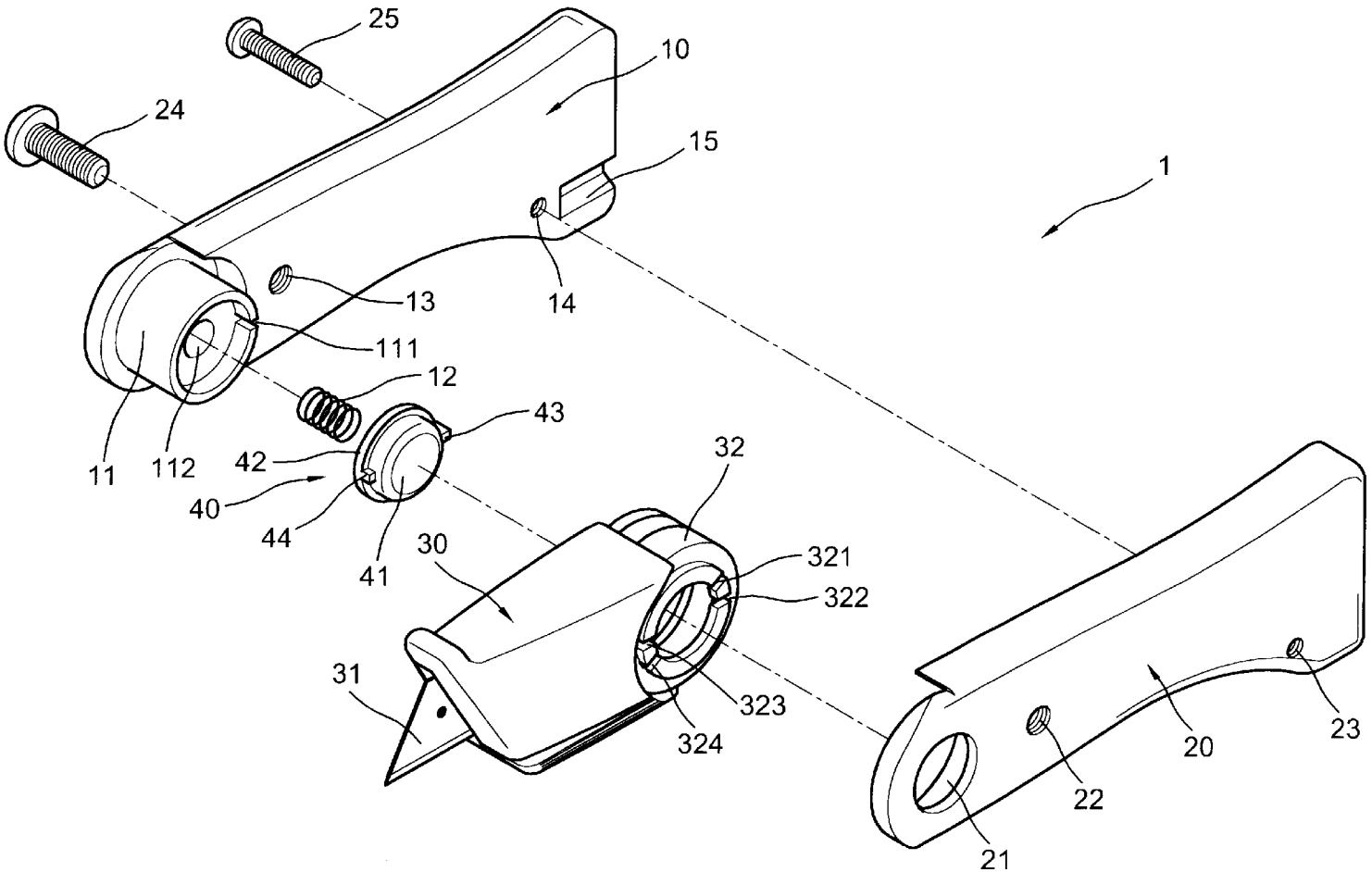
FIG. 1 is an exploded perspective view of the preferred embodiment of the present invention.
Figure 2:
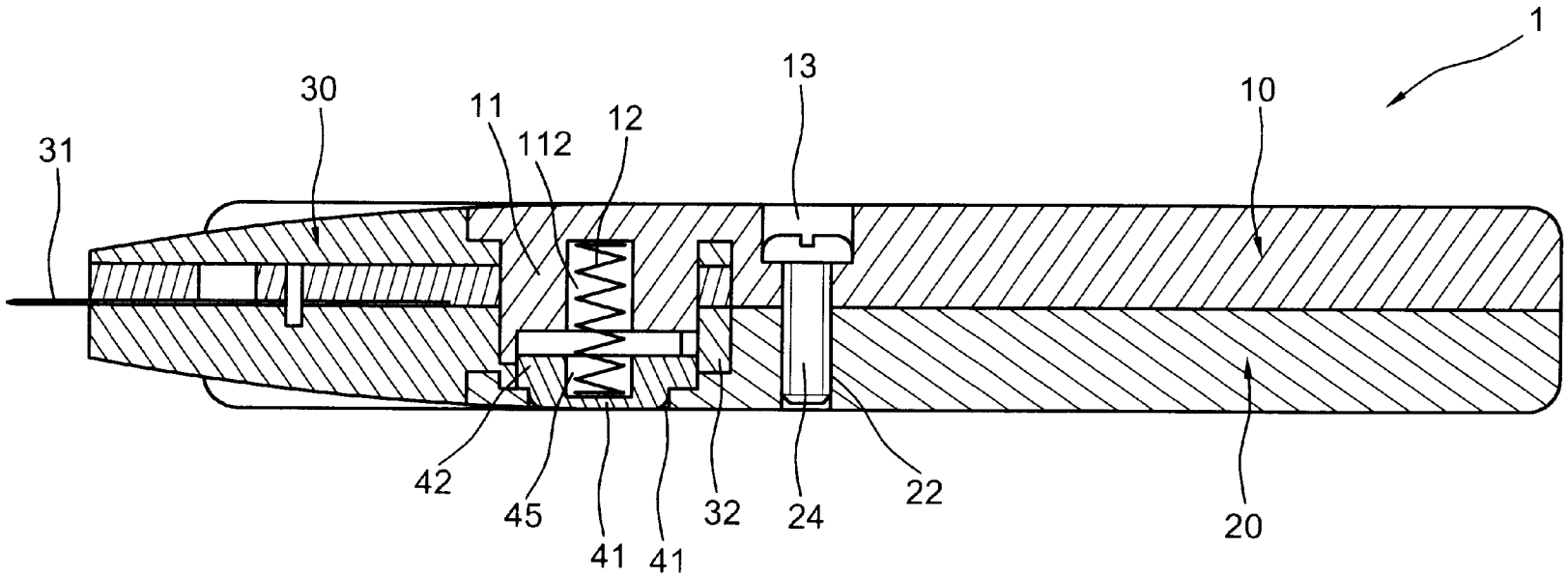
FIG. 2 is a top sectional view of the assembly of the present invention.
Figure 3:
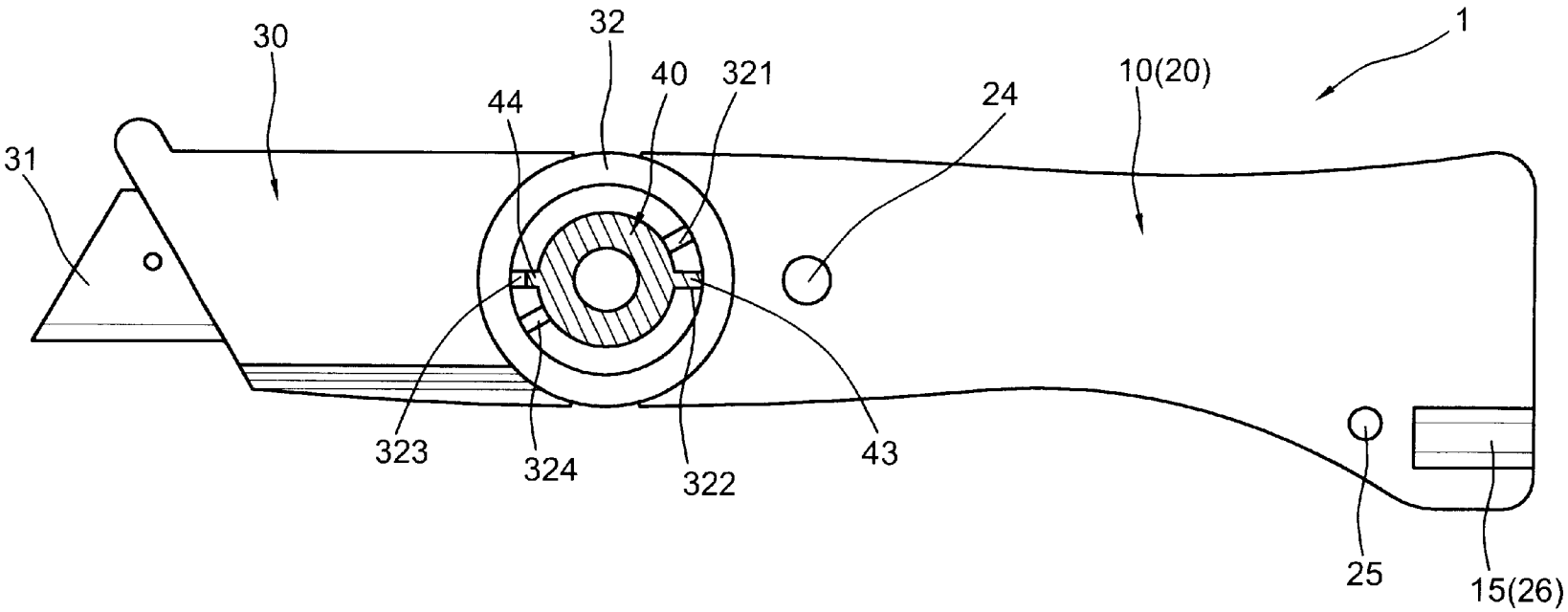
FIG. 3 is a side section of FIG. 2.

With reference to FIGS. 1, 2 and 3, of the drawings, the artistic knife with adjustable handle of the present invention comprises a straight handle 1 including a first half 10 and a second half 20 wherein a head 30 is rotatably gripped by the first half 10, the second half 20 and a positioning member 40 in which the movement of the head 30 is controlled.

The first half 10 has a tubular projection 11 projecting inward from an inner surface abutting the front end thereof including an axial slot 111 in a peripheral wall and a circular groove 112 in the bottom for engaging one end of a spring 12, a pair of transverse screw holes 13 and 14 spacedly formed in the body and a rectangular groove 15 in an inner surface of the rear end of the first half 10.

The second half 20 has a circular through hole 21 is located adjacent the front end of said second half 20 in registry with the tubular projection 11 of the first half 10, a pair of transverse screw holes 22 and 23 spacedly formed are in the body of the second half 20 for engaging with the screw holes 13 and 14 of the first half 10 and a rectangular groove 26 in an inner surface abutting the rear end of the second half 20 in registry with the rectangular groove 15 of the first half 10 (as shown in FIG. 3).

The head 30 has a blade 31 secured to front end and an annular ring 32 on the rear end sleeved on the tubular projection of the first half. The annular ring 32 has two pairs of mortises 321 and 324, 322 and 323 symmetrically formed in an inner flange thereof.

The positioning member 40 has a circular body, a protrudent surface 41 on the front side, an annular flange 42 on the back side, a large tenon 43 and a small tenon 44 which are formed symmetrically on opposing peripheries abutting the flange 42 and a circular groove 45 of the positioning member 40 in bottom for disposing other end of the spring 12 as shown in FIG. 2, which provides resilience to the positioning member 40.

When assembling, first dispose the spring 12 and the positioning member 40 into the tubular projection 11 of the first half 10 with the large tenon 42 slidably engaged into the axial slot 111, then sleeve the annular ring 32 of the head 30 onto the tubular projection 11 so that the positioning member 40 will not be jumped out due to the inner flange of the annular ring 32. Finally, combine the second half 20 of the straight handle 1 with the first half 10 and secured by a pair of screws 24 and 25 through the screw holes 13, 22 and 14, 23.

After the accomplishment of assembly, the tenons 43 and 44 are respectively engaged with the mortises 321 and 324 and the protrudent surface 14 is engaged within the circular through hole 21 of the second half 20. Therefore, the head 30 is parallel to the straight handle 1. The rectangular grooves 15 and 26 of the first and second halves 10 and 20 are combined into a rectangular cavity for the engagement of a shank of a screwdriver therein (as shown in FIG. 3).

Figure 4:
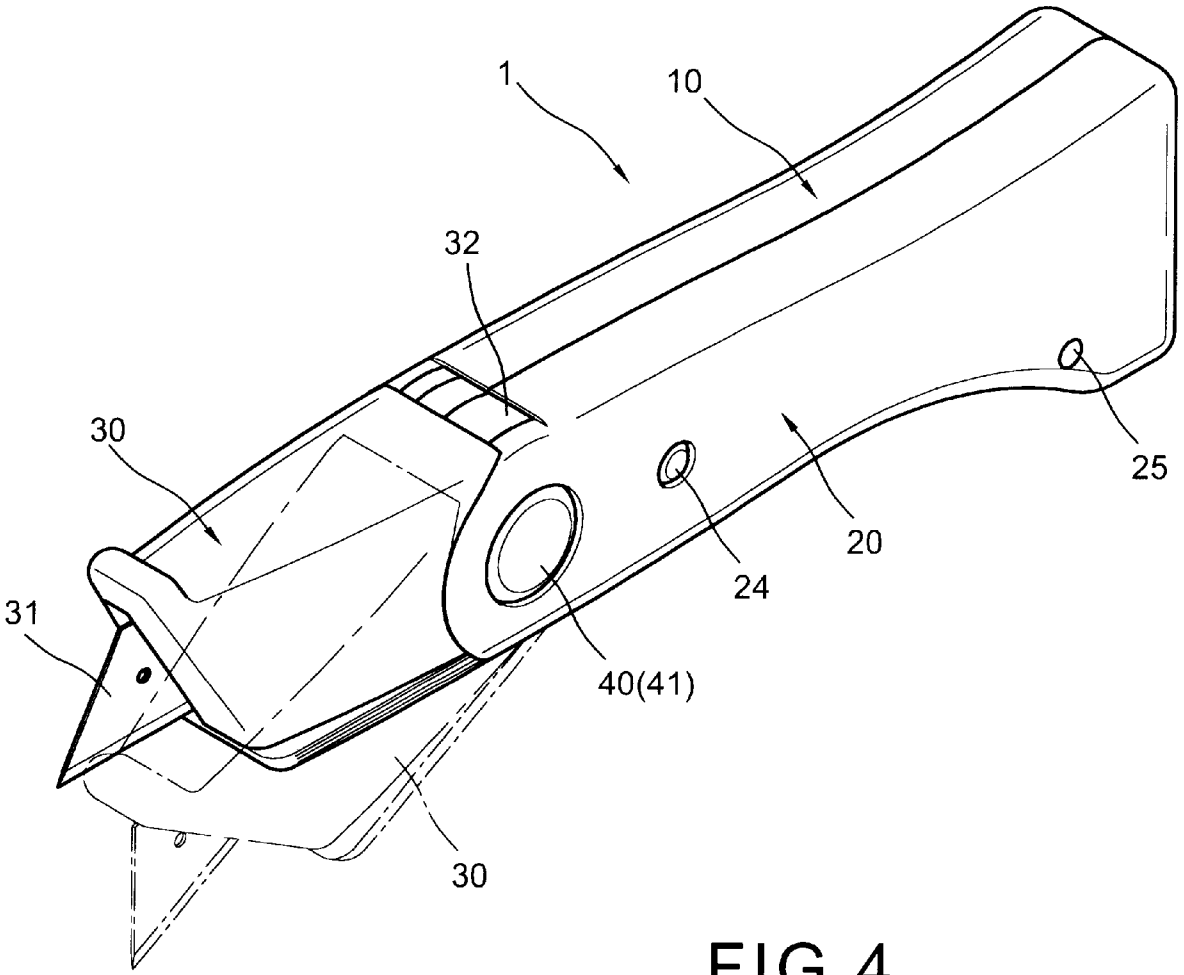
FIG. 4 is a perspective view of that the head is bent downward to form a certain degree angle with the straight portion of the handle.
Figure 5:
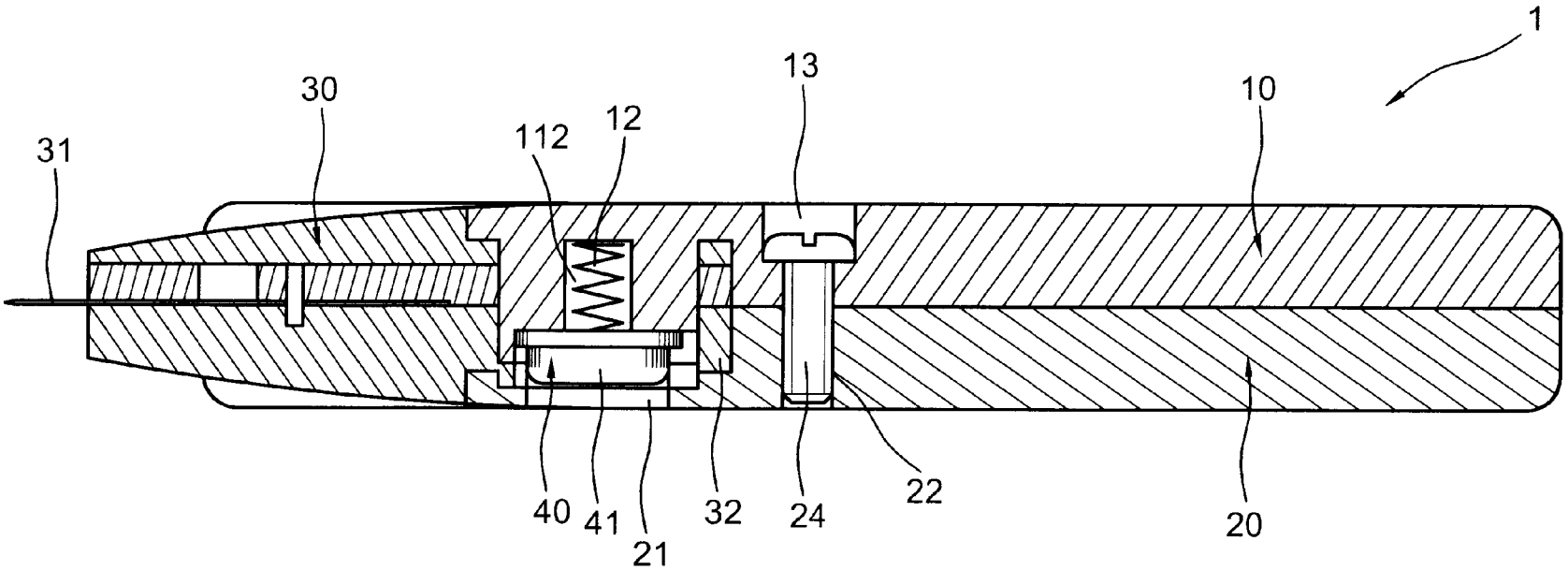
FIG. 5 is a top sectional view of FIG. 4.
Figure 6:
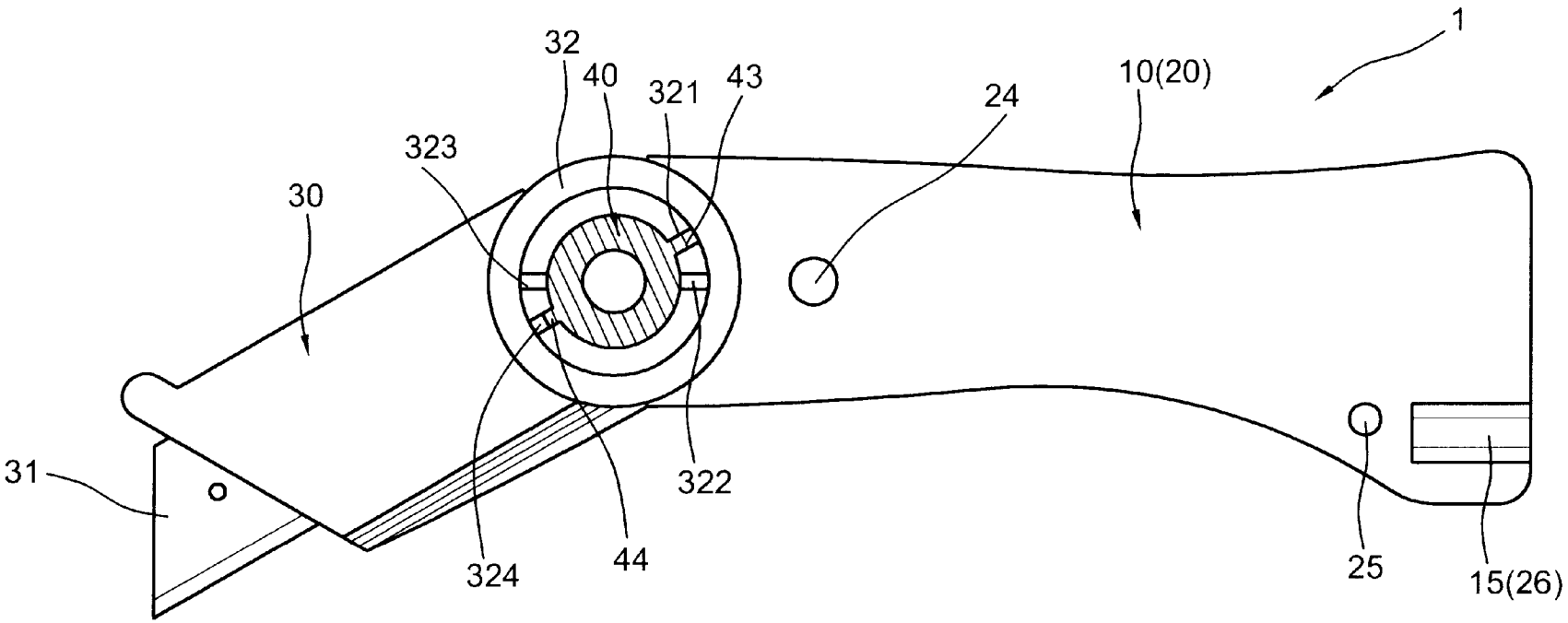
FIG. 6 is a side view of FIG. 4.

Referring to FIGS. 4, 5 and 6, when press the protrudent surface 41 of the positioning member 40 inward, the tenons 43 and 44 are disengaged from the mortise 231 and 234 so as to set the head 30 free to rotate counterclockwise for a certain degree of angle. Upon releasing of the positioning member 40, the tenons 43 and 44 will be automatically engaged with the mortises 322 and 323 so that the head 30 forms a certain degree of angle with the straight handle 1 to permit the user to cut the work piece in deference manner. Actually, more mortises can be made in the inner flange of the annular ring 30 in order to facilitate the user to make different angles between the head 30 and straight handle 1.

Note that the specification relating to the above embodiment should be construed as an exemplary rather than as a limitative of the present invention, with many variations and modifications being readily attainable by a person of average skill in the art without departing from the spirit or scope thereof as defined by the appended claims and their legal equivalents.

We claim:

1. An artistic knife with adjustable handle comprising:

a straight handle which is combined with a first half and a second half; said first half having a tubular projection projecting inward from an inner surface abutting front end thereof, said tubular projection including an axial slot in a peripheral wall and a first circular groove in bottom for disposing one end of a spring, a pair of first transverse screw holes spacedly formed in the body of said first half and a first rectangular groove in an inner surface of rear end thereof; said second half having a circular through hole is located adjacent front end of said second half in registry with the tubular projection of said first half, a pair of second transverse screw holes are formed in the body of the second half for engagement with the first transverse screw holes and a rectangular groove is formed on an inner surface of said second half in registry with the first rectangular groove of said first half;

a positioning member having a circular body engaged into the tubular projection of said first half, a protrudent surface on the front side of the positioning member for engaging in the circular through hole of said second half, an annular flange on the back, a large tenon and a small tenon are formed symmetrically on the opposing outer peripheries abutting said annular flange, wherein said large tenon is slidably engaged into the axial slot of said tubular projection and a second circular groove in bottom for disposing other end of said spring;

a head member rotatably gripped by said first and second halves and having a blade on front end and an annular ring on rear end sleeved onto the tubular projection of said first half with said positioning member engaged therein; said annular ring having an inner flange in which two pairs of mortises are formed symmetrically for engaging the large and the small tenons of said positioning member respectively;

whereby upon pressing said positioning member inward enables said head to rotate a certain degree of angle relative to said straight handle.

2. The artistic knife as recited in claim 1, wherein said first half and said second half are secured together by a pair of screws through said first and second transverse screw holes respectively.

3. The artistic knife as recited in claim 1, wherein said mortise can be increased in number and said head can turn on several different angles relative to said straight handle and enable the user to rotate the cutting head at different desired angles.

4. The artistic knife as recited in claim 1, wherein said first rectangular groove and said second rectangular groove are forming rectangular cavity in rear end of said straight handle for engaging a shank of a screwdriver.

* * * * *